US006044805A

United States Patent [19]

Walker et al.

[11] Patent Number: 6,044,805

[45] Date of Patent: Apr. 4, 2000

[54] WALL PROTECTION FROM DOWNWARD FLOWING SOLIDS

[75] Inventors: David J. Walker, Wadsworth; Donald L. Wietzke, Copley, both of Ohio

[73] Assignee: The Babcock & Wilcox Company, New Orleans, La.

[21] Appl. No.: 09/305,962

[22] Filed: May 6, 1999

[51] Int. Cl.[7] ..... F22B 37/10

[52] U.S. Cl. ..... 122/512; 122/511; 122/DIG. 13; 122/235.11; 122/235.12; 122/235.14

[58] Field of Search ..... 122/511, 512, 122/DIG. 13, 235.11, 235.12, 235.14, 6 A, 4 D

[56] References Cited

U.S. PATENT DOCUMENTS 4,538,550 9/1985 Haller et al. ..... 122/235.18
4,721,069 1/1988 Kreider ..... 122/511
5,107,798 4/1992 Gerep ..... 122/6 A
5,755,188 5/1998 Phelps ..... 122/511

*Primary Examiner*—Teresa J. Walberg
*Assistant Examiner*—Jiping Lu
*Attorney, Agent, or Firm*—Robert J. Edwards; Eric Marich

[57] ABSTRACT

A tube wall, division wall, or wing wall section for a circulating fluidized bed boiler with improved erosion resistant characteristics has a reduced diameter tube section adjacent the refractory covered by an abrasion resistant refractory tile. The refractory tile is mounted to the reduced diameter tube section with the upper edge of the refractory tile outside of or not extending beyond a solids fall line of solids in the fluidized bed to eliminate exposed discontinuities.

20 Claims, 18 Drawing Sheets

WALL PROTECTION FROM DOWNWARD FLOWING SOLIDS

FIELD AND BACKGROUND OF THE INVENTION

1. FIELD OF THE INVENTION

The present invention relates generally to the field of circulating fluidized bed boilers and, in particular, to a new and useful configuration for reducing or eliminating tube erosion in the region of the top of the refractory covering on lower furnace walls, or on wing walls or division walls.

2. BACKGROUND OF THE INVENTION

In circulating fluidized bed boilers, the problem of erosion of tubes at the top edge of refractory lining is well known.

In a circulating fluidized bed boiler, reacting and non-reacting solids are entrained within the enclosure by the upward flow of gases which carry some solids to the reactor exit at the upper end of the reactor. Other, larger quantities of solids are recycled within the reactor enclosure as heavier solids initially carried upwards fall back against the flow of gases. Since the velocity of the upward flow of gases is often much lower in the cooler gases adjacent the circulating fluidized bed enclosure walls and heat transfer surfaces within the circulating fluidized bed, most of the solids fall near the walls or heat transfer surfaces.

The amount of solids falling adjacent to the walls and surfaces increases progressively toward the bottom of the circulating fluidized bed. The density of the bed is higher in the lower regions of the furnace, and as a result, the walls and surfaces in the lower regions are subject to increased erosion from contact with the solids.

Further, the reactions occurring in the circulating fluidized bed create chemical reduction conditions against which the walls and heat transfer surfaces must be protected. A protective material (further called refractory) is often used to coat the walls and exposed surfaces in the lower regions of the circulating fluidized bed. The refractory material, anchoring and installation is expensive, since it must withstand high temperatures (typically between 1400° and 1800° F.), contact erosion from solids, and chemical reduction and by-products from the combustor reactions. The refractory also reduces the efficiency of the heat transfer. For this reason, refractory is only applied to the walls and exposed surfaces to as low an elevation in the reactor region as possible considering corrosion and erosion conditions. At the point on the walls and surfaces where the refractory terminates, a discontinuity is formed where erosion of the metal of the tubes forming the walls occurs. The erosion is typically in a band about ¼" to 3" wide adjacent the top edge of the protective material. Tube wall erosion is found in an area between 0 and 36 inches above the top of the refractory.

One method for reducing this erosion is found in U.S. Pat. No. 5,893,340 to Belin et al. in which the walls of the enclosure are bent into and out of the solid flow stream to reduce the incidence of solids on the refractory discontinuity.

An alternative known method is to place a protective overlay material on the tube at the refractory discontinuity as a shield. The protective overlay extends from below the termination of the refractory to several inches above the discontinuity. Unfortunately, the protective overlay suffers the same erosion and must eventually be replaced in an expensive and time consuming procedure.

None of the prior methods are completely successful in eliminating erosion near the refractory.

SUMMARY OF THE INVENTION

It is an object of the present invention to provide an efficient alternative tube section design for a wall, wing wall, or division wall which reduces tube erosion adjacent a refractory discontinuity in a circulating fluidized bed boiler.

Accordingly, one aspect of the present invention is drawn to a tube wall section for a circulating fluidized bed boiler which has a swaged section of tubes above a refractory discontinuity partly covered by an abrasion-resistant refractory tile or shaped refractory. The refractory tile or shaped refractory is mounted over the swaged section and a lower adjacent reduced diameter tube section covered by the refractory. The membrane bar between adjacent tubes is modified in the swaged tube section and reduced tube diameter section to permit mounting of the refractory tile or shaped refractory over the tubes. A mirror image swaged section may be provided below the reduced diameter tube section to bring the tube back to the original or another diameter in the tube wall covered by refractory.

The refractory tile may be mounted in one of several alternative ways. In one embodiment, bolts or studs, and nuts, may be used to secure the refractory tile. Alternatively, locking clips which are connected to the bottom of the refractory tile segment may be used. A locking tab mount may be used with the locking clips. The tabs extend upwardly between adjacent swaged tube sections where the tabs are held between the modified membrane bar and the regular membrane bar to secure the refractory tile in place. The shaped refractory is held in place by studs and anchors welded to the tubes and membrane.

The original tube diameter above the tapered portion of the swage and the inner surface of the membrane bar define the fall line for solids within the circulating fluidized bed, while the swaged tube section with the modified or displaced membrane bar creates a space which is outside the fall line. The protective abrasion resistant refractory tile or shaped refractory resumes the fall line and covers the exposed tube sections down to the refractory. The top edge of the refractory tile or shaped refractory is outside the fall line as well, so that the discontinuity line is not simply moved upwards.

In another aspect of the present invention, the above-described concept is applied to refractory discontinuities on wing walls or division walls located within the furnace of a circulating fluidized bed boiler. As will be described later, in such applications the refractory tiles would be shaped slightly differently and applied back to back on both sides of the section comprising the wing walls or division walls. Where the membrane bar is stepped back for the enclosure walls, it is simply stopped, leaving a gap, for such wing walls or division walls inside the furnace.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
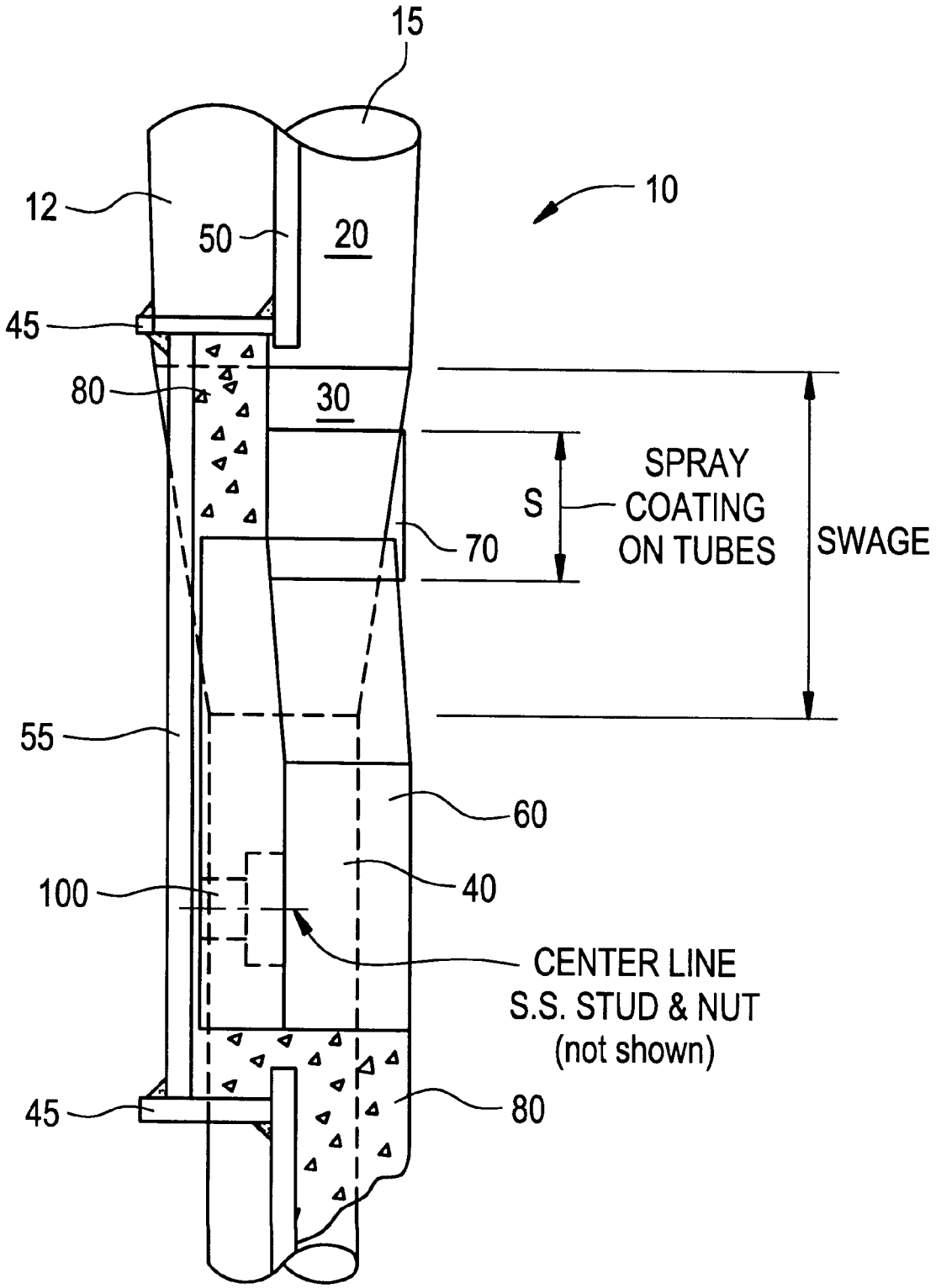
FIG. 1 is a side elevational view of a circulating fluidized bed boiler wall section according to a first embodiment of the invention.
Figure 2:
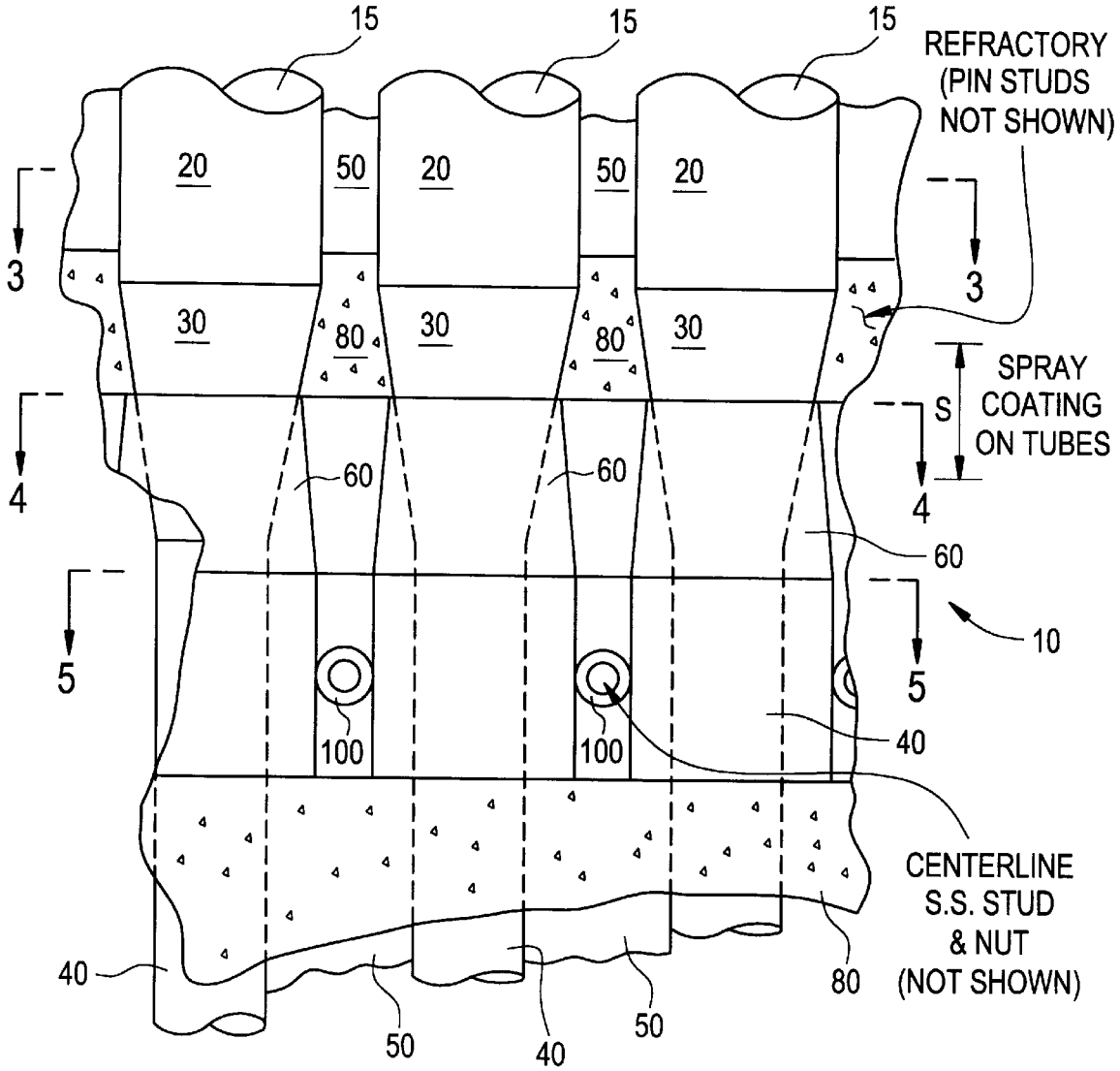
FIG. 2 is a front elevational view of the wall section of FIG. 1.

Referring to the drawings generally, wherein like reference numerals designate the same or functionally similar elements throughout the several drawings, and to FIGS. 1 and 2 in particular, there is shown a section 10 of a tube wall 12 at the point of refractory discontinuity in a circulating fluidized bed boiler. Each tube 15 in the tube wall is formed from upper tubes 20 having a tube diameter, such as 3 inches. At a lower end of upper tube 20, a swaged tube section 30 tapers the diameter of the tube 15 to a reduced diameter tube section 40.

Figure 3:
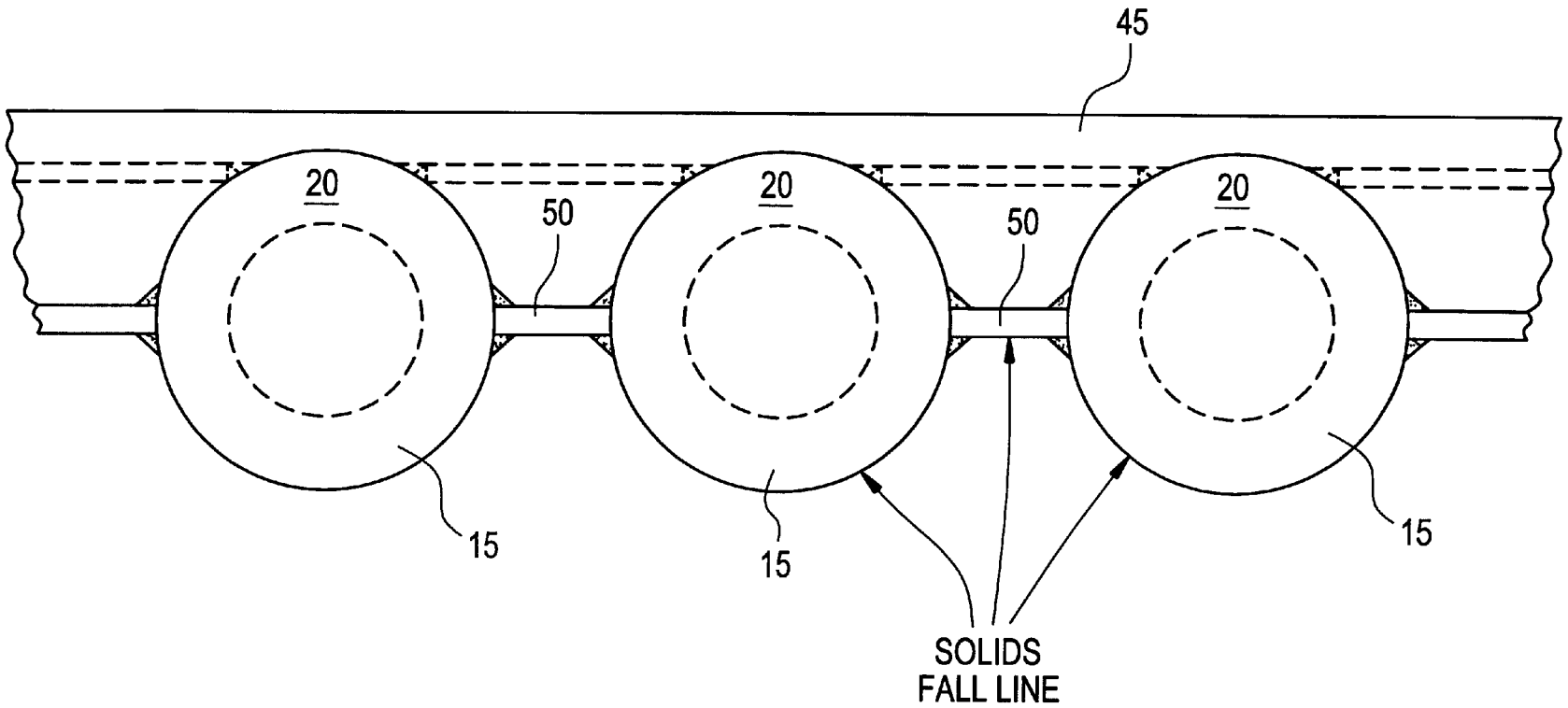
FIG. 3 is a sectional top plan view of the wall section of FIG. 2 taken along line 3—3.

As seen in FIG. 3, the tubes 15 are joined by membrane bars 50 which extend horizontally between adjacent tubes 15 at upper tubes 20. The membrane bars 50 divide the tubes 15 into two halves, one of which is the interior wall facing the furnace region of the circulating fluidized bed boiler (i.e., the furnace side), the other being outside thereof. Inside the circulating fluidized bed boiler, the surfaces of the tubes 15 inside the furnace at upper tubes 20 and inner surfaces of membrane bars 50 at upper tubes 20 define a "solids fall line", along which the solids in the fluidized bed drop. Objects which project into the solids fall line will be contacted by falling solids, while portions of the tube 15 outside the fall line will not.

Returning to FIGS. 1 and 2, a refractory tile 60 is positioned over a portion of the swaged tube section 30 and over a part of the reduced diameter tube section 40. The refractory tile 60 is arranged so that the upper edge of the refractory tile 60 is outside the solids fall line. The refractory tile 60 conforms to the shape of the tubes 15 and fits over the exposed, interior side of the tubes 15. Alternatively, the present invention contemplates that refractory specially shaped to the contours shown for refractory tile 60 may also be used.

The refractory tile 60 may be provided with a curved portion 62 which partially encircles a portion of the tube 15, and a tail portion 64 which can be used to secure the refractory tile 60 to the fitted membrane bar 55. Advantageously, an end of the curved portion 62 has a beveled portion 66 which contacts a complementary beveled portion 68 on the tail portion 64. This complementary beveled end configuration helps to jam or secure the curved portion 62 of each refractory tile 60 against the curved wall of the tube 15.

Figure 4:
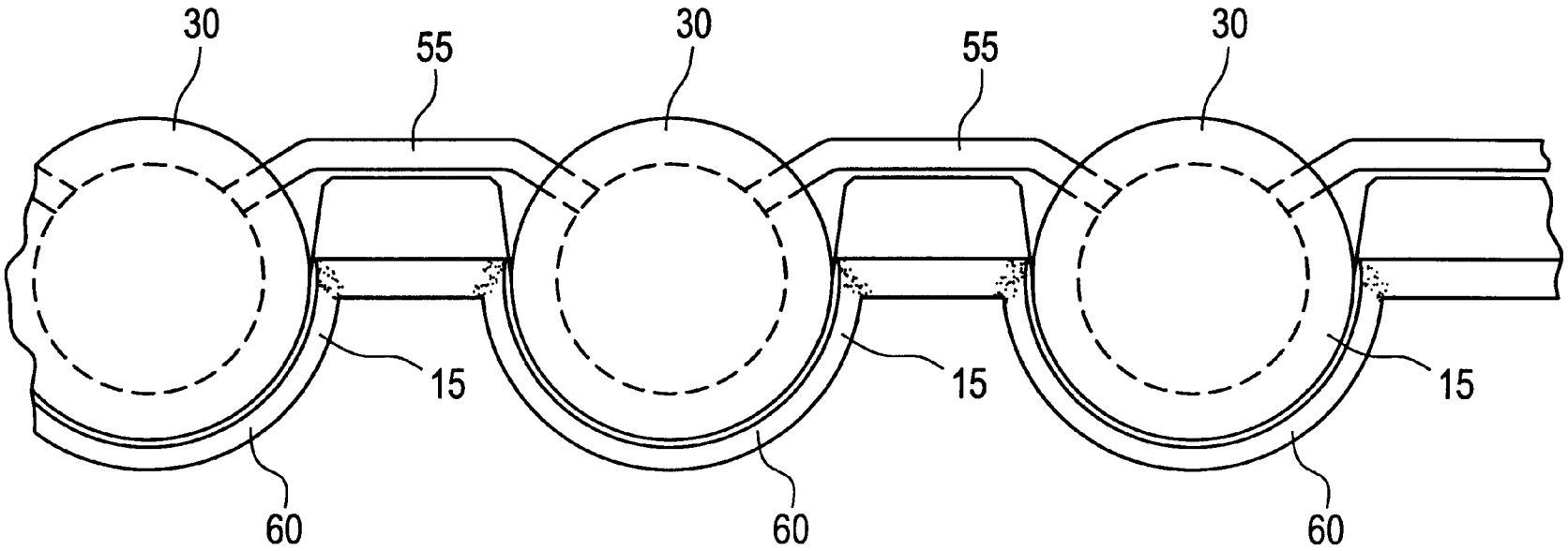
FIG. 4 is a sectional top plan view of the wall section of FIG. 2 taken along line 4—4
Figure 5:
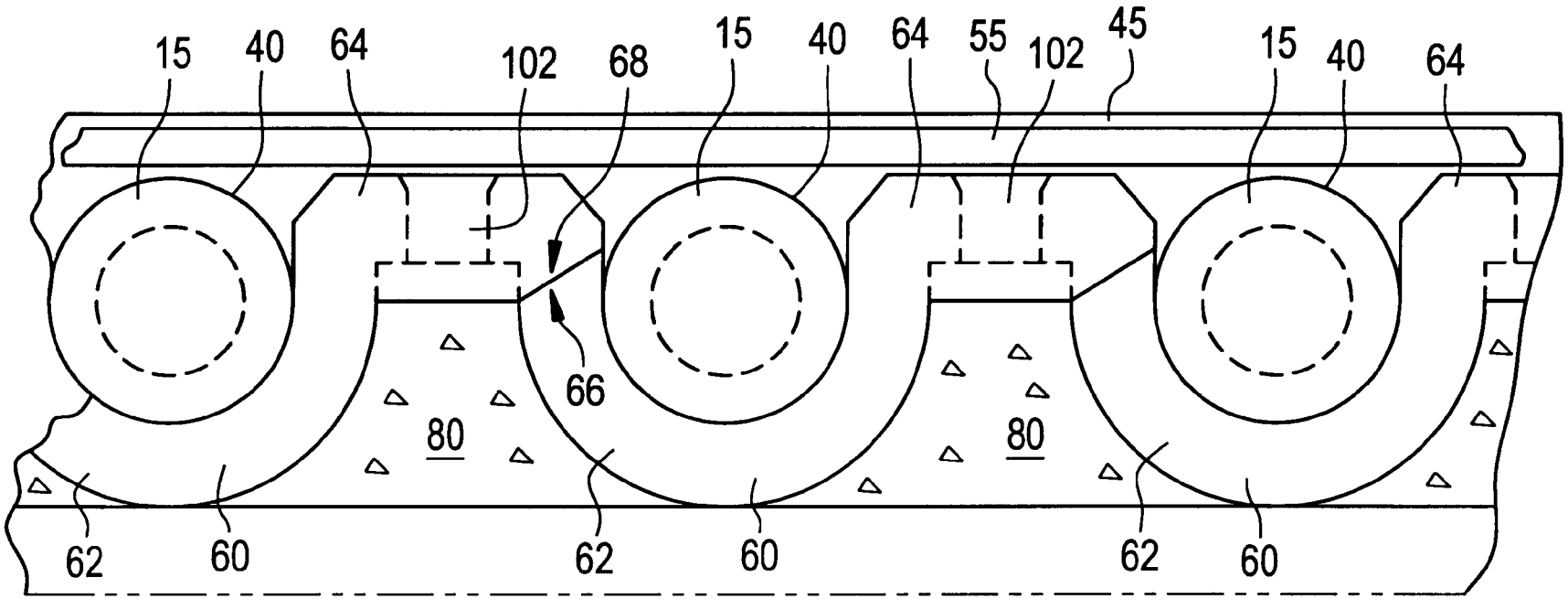
FIG. 5 is a sectional top plan view of the wall section of FIG. 2 taken along line 5—5.
Figure 6:
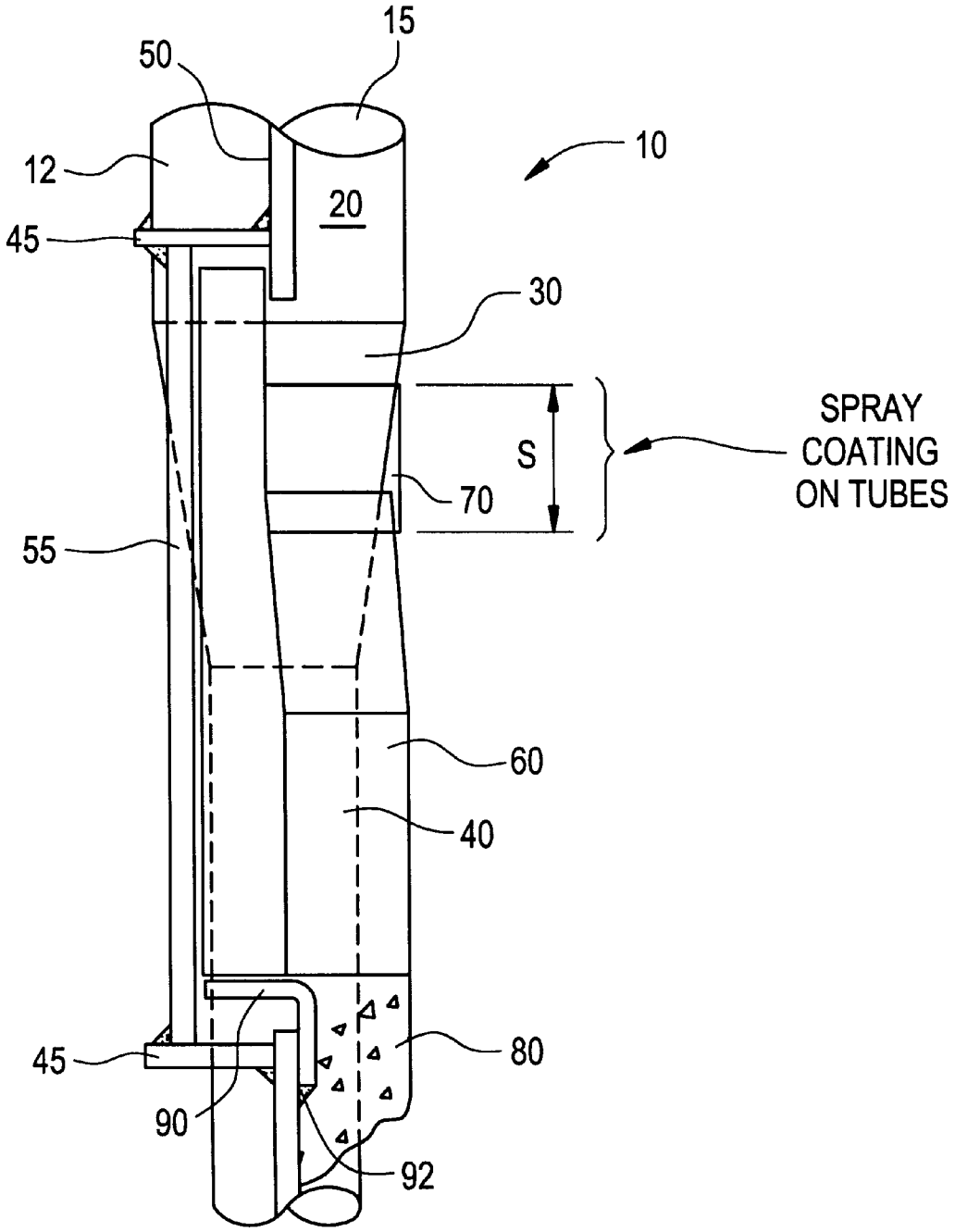
FIG. 6 is a side elevational view of a circulating fluidized bed boiler wall section according to a second embodiment of the invention.
Figure 7:
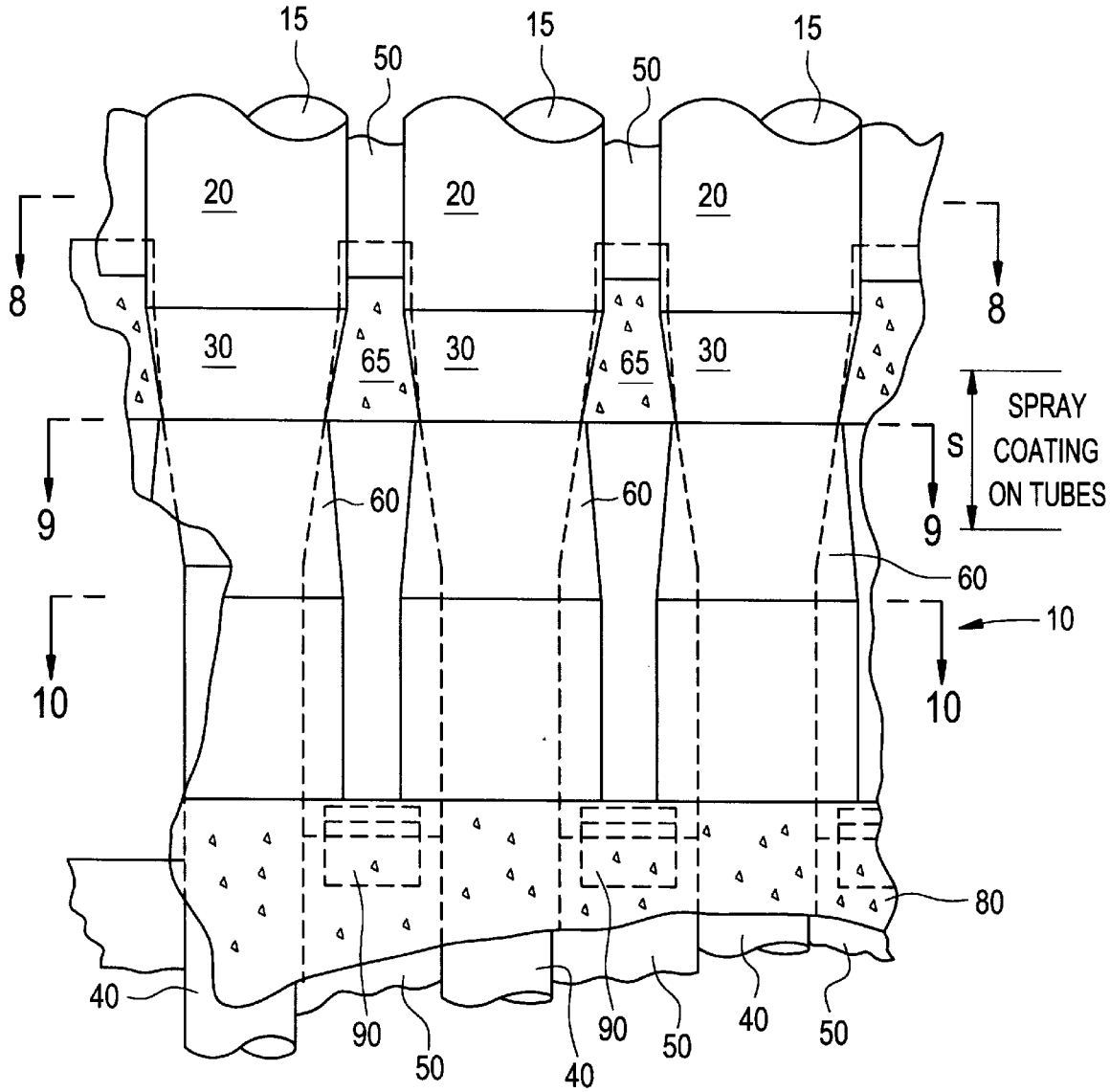
FIG. 7 is a front elevational view of the wall section of FIG. 6.
Figure 8:
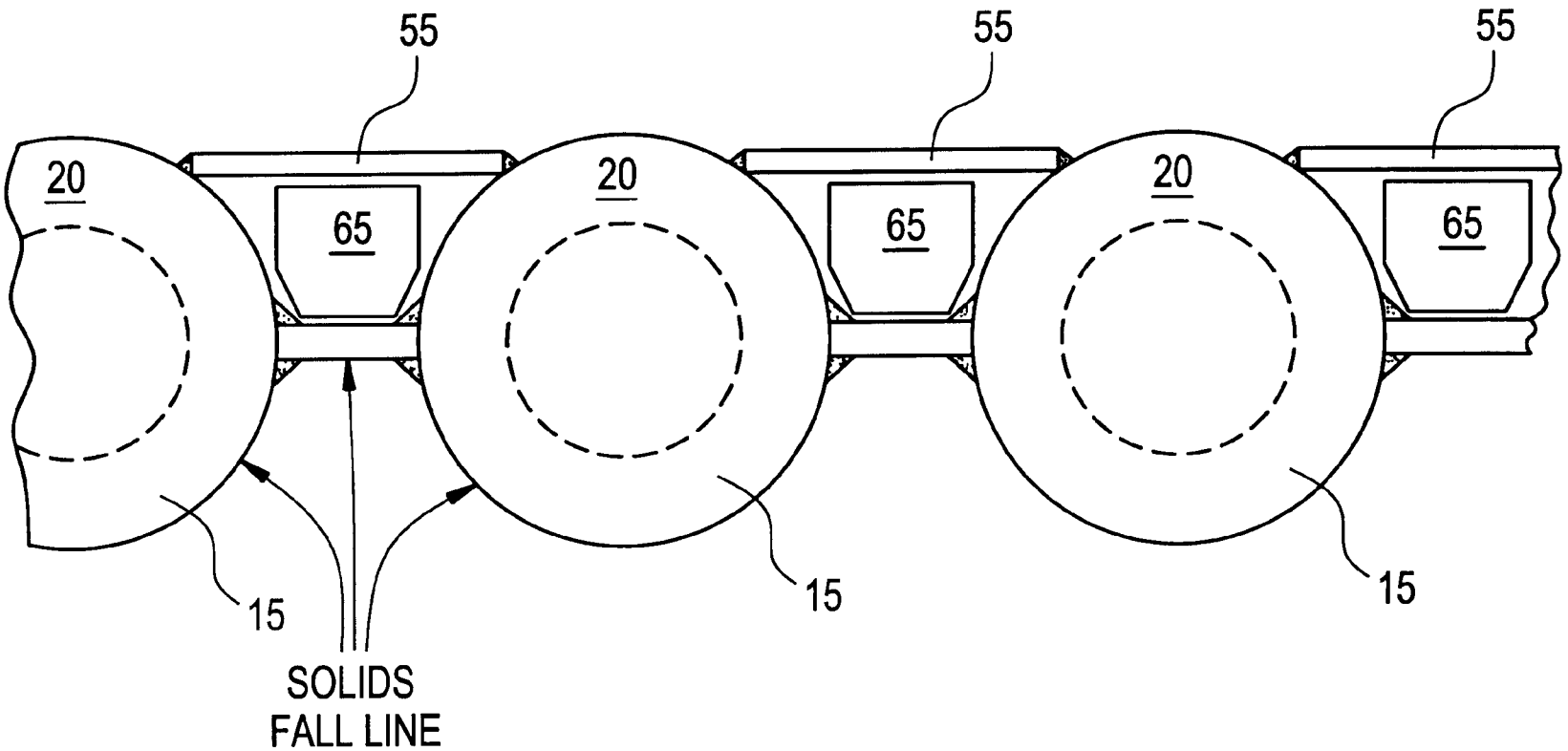
FIG. 8 is a sectional top plan view of the wall section of FIG. 6 taken along line 8—8.
Figure 9:
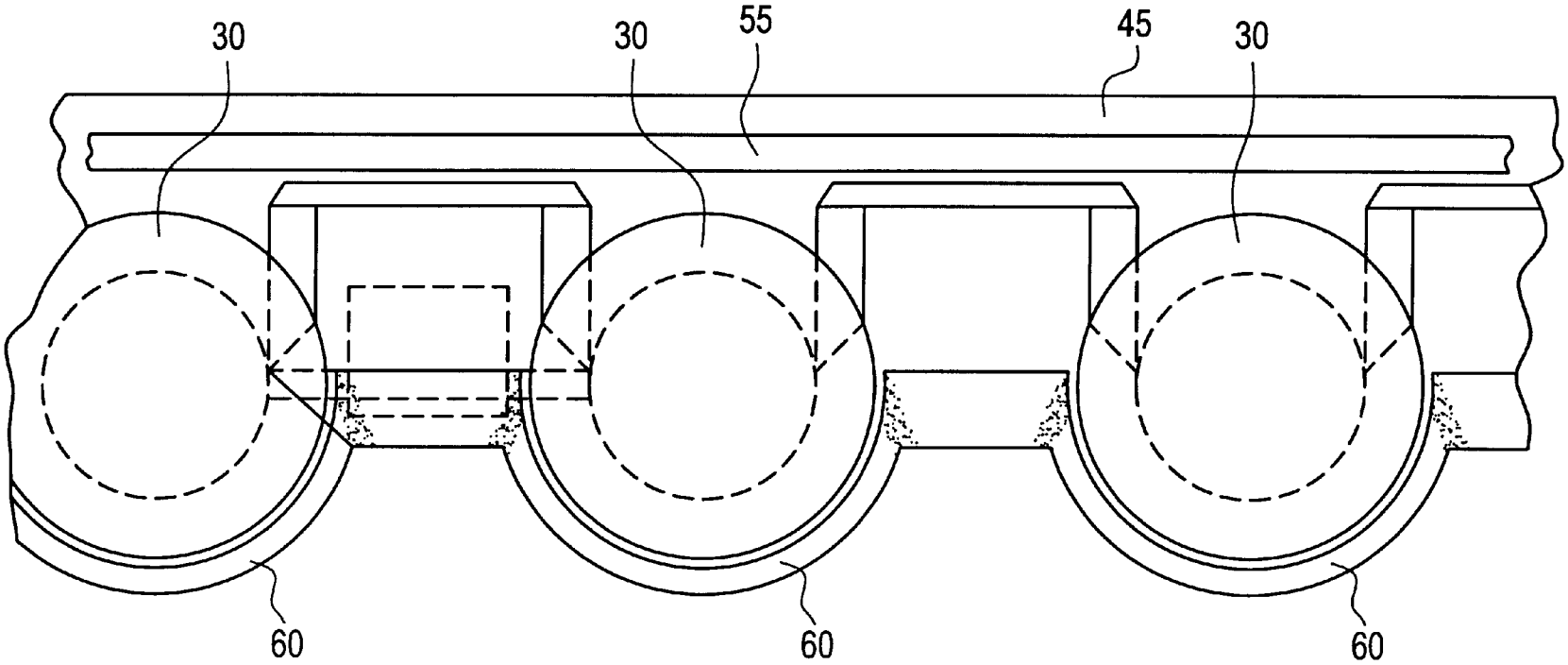
FIG. 9 is a sectional top plan view of the wall section of FIG. 6 taken along line 9—9.
Figure 10:
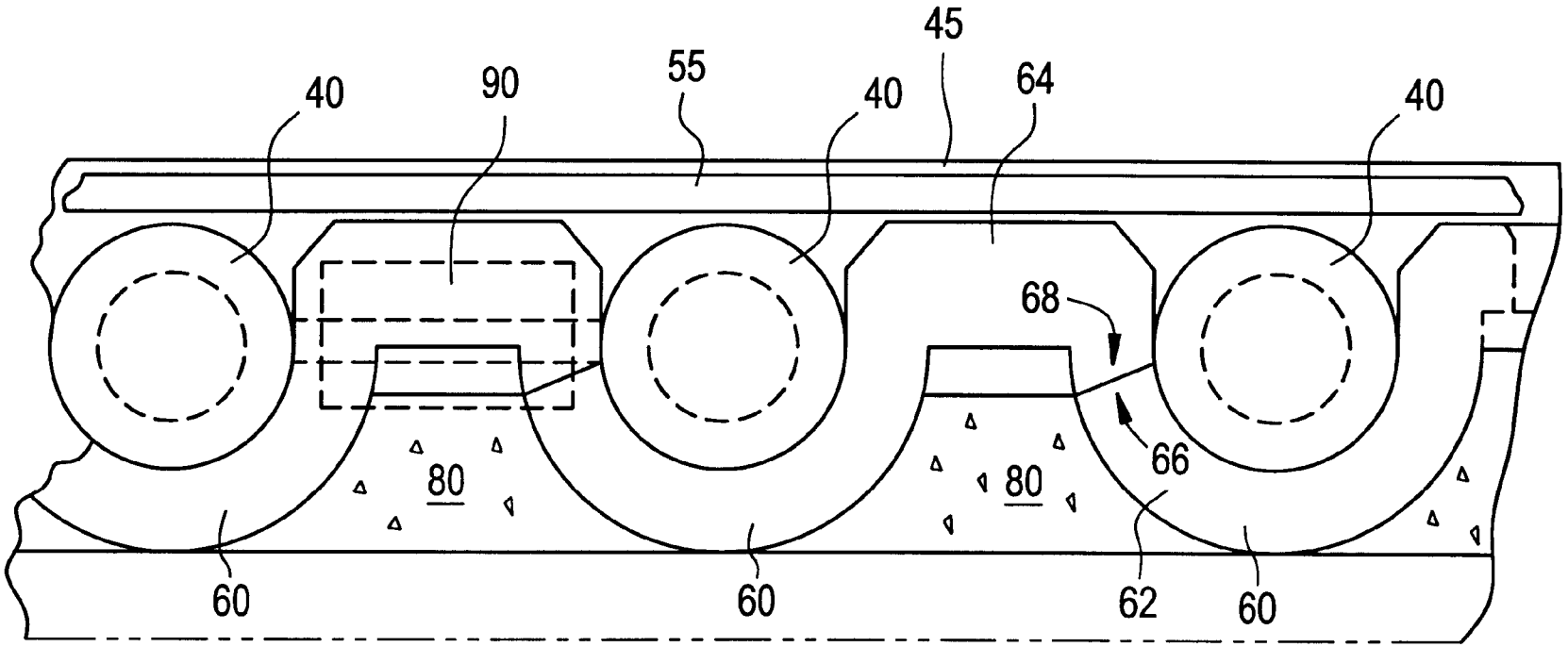
FIG. 10 is a sectional top plan view of the wall section of FIG. 6 taken along line 10—10.
Figure 11:
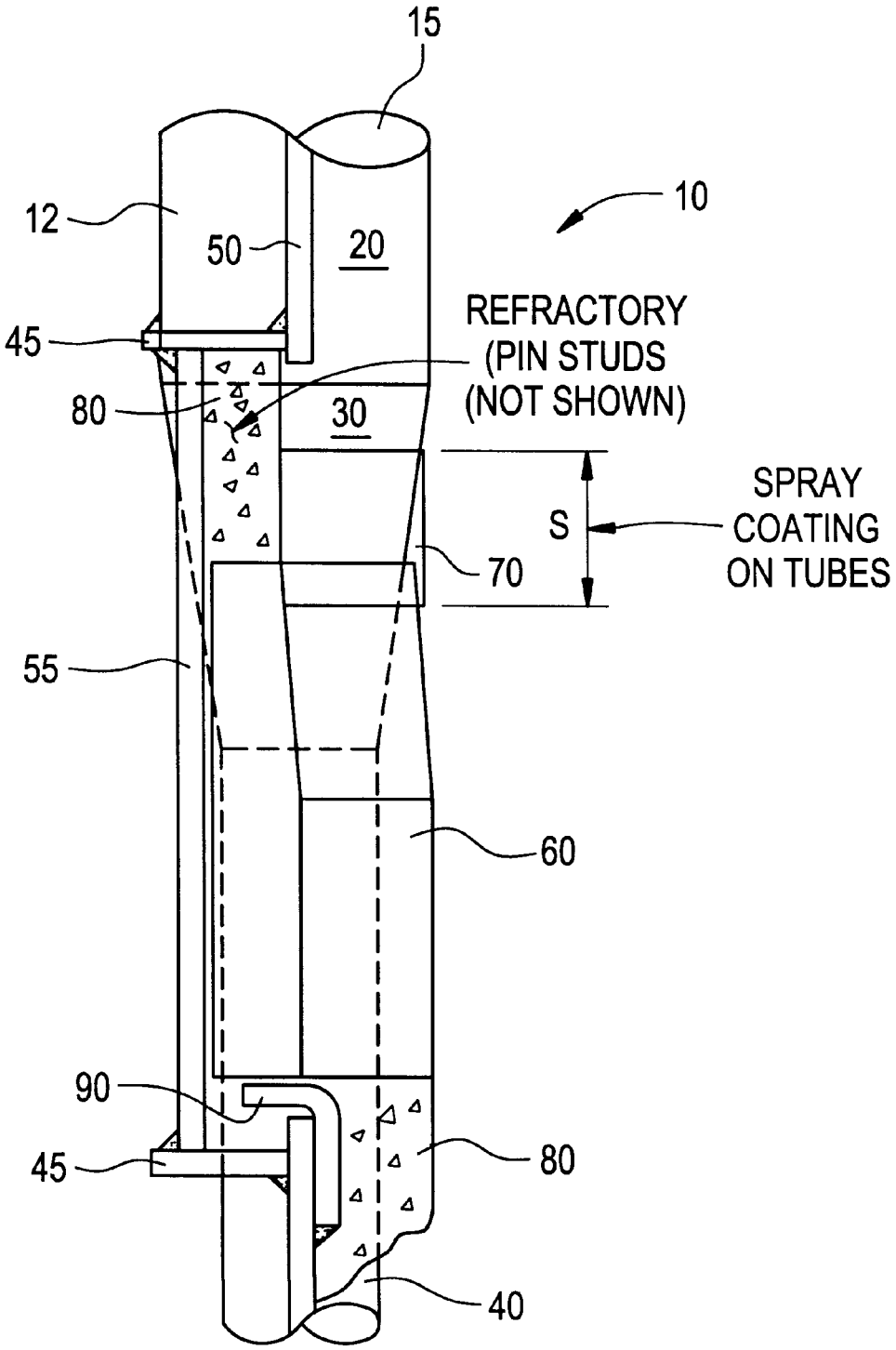
FIG. 11 is a side elevational view of a circulating fluidized bed boiler wall section according to a third embodiment of the invention.
Figure 12:
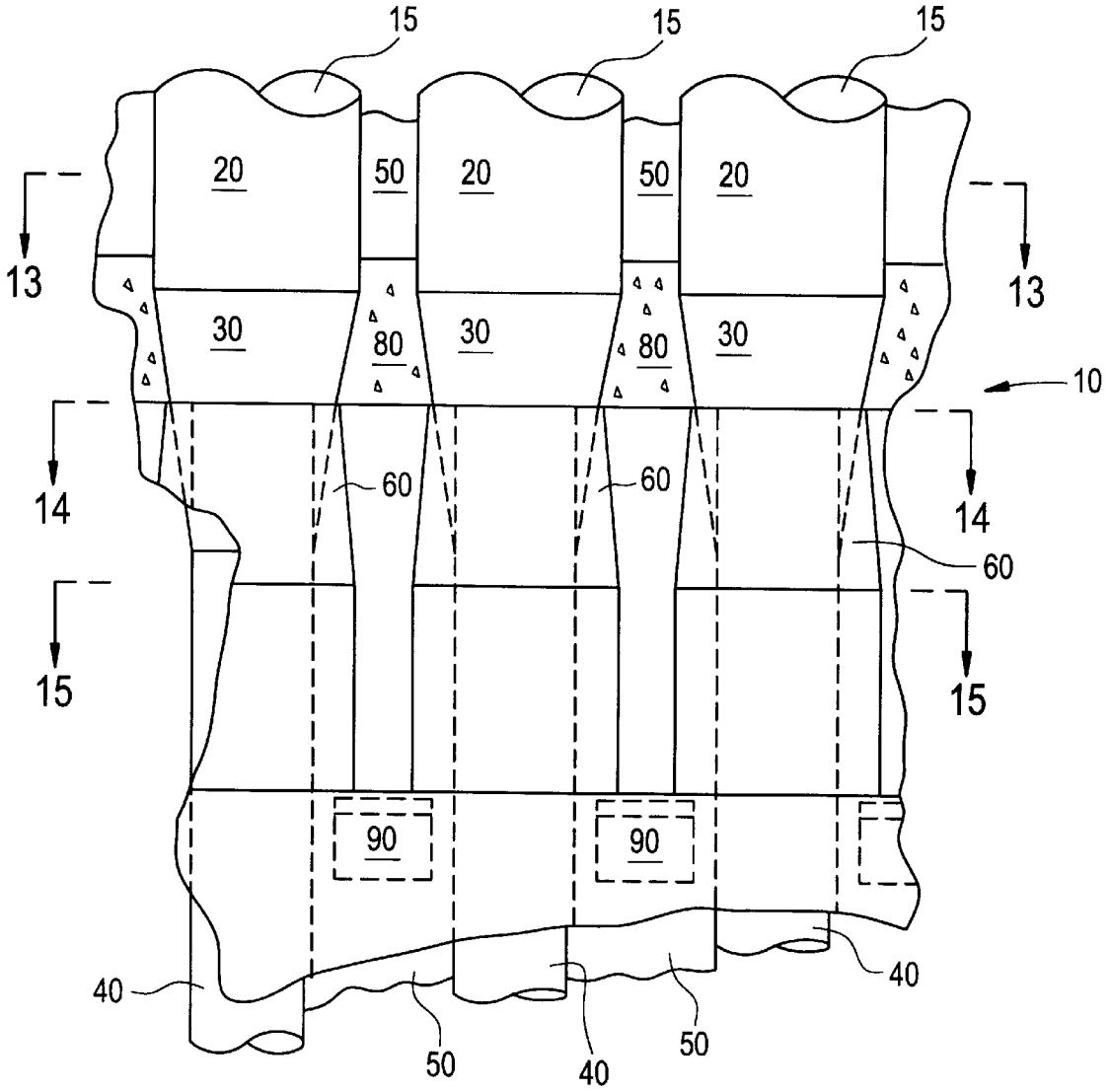
FIG. 12 is a front elevational view of the wall section of FIG. 11.
Figure 13:
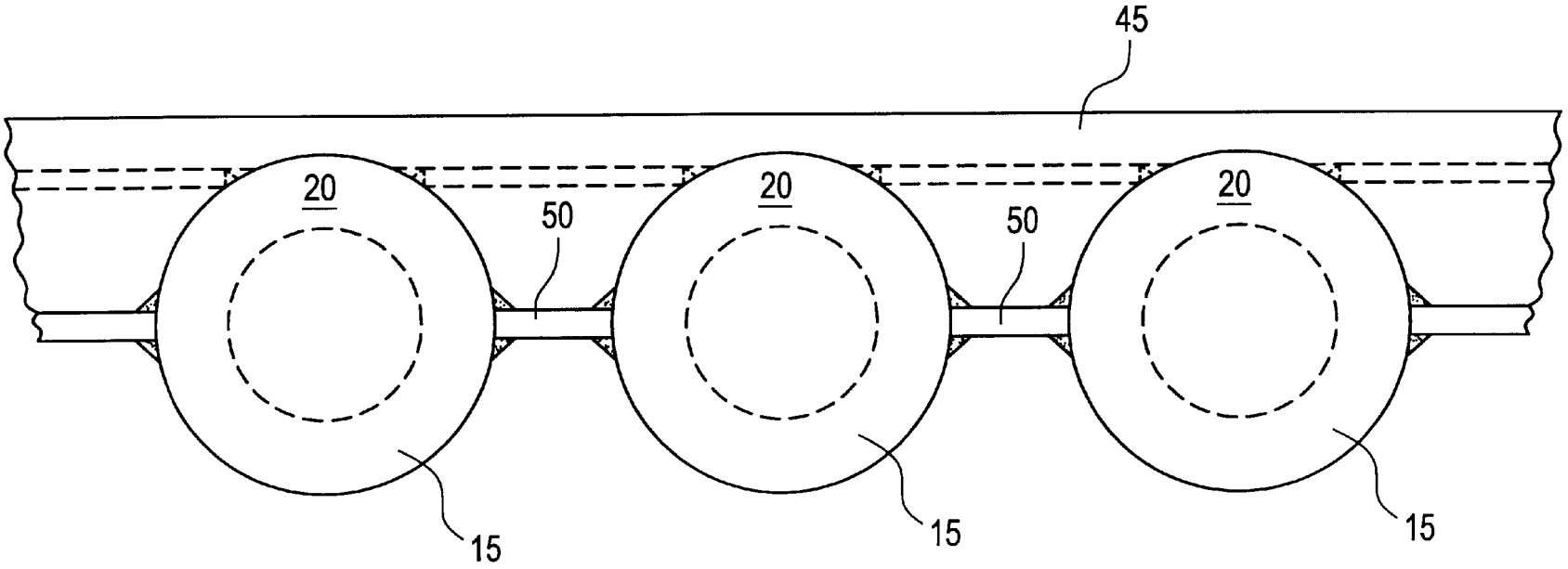
FIG. 13 is a sectional top plan view of the wall section of FIG. 11 taken along line 13—13.
Figure 14:
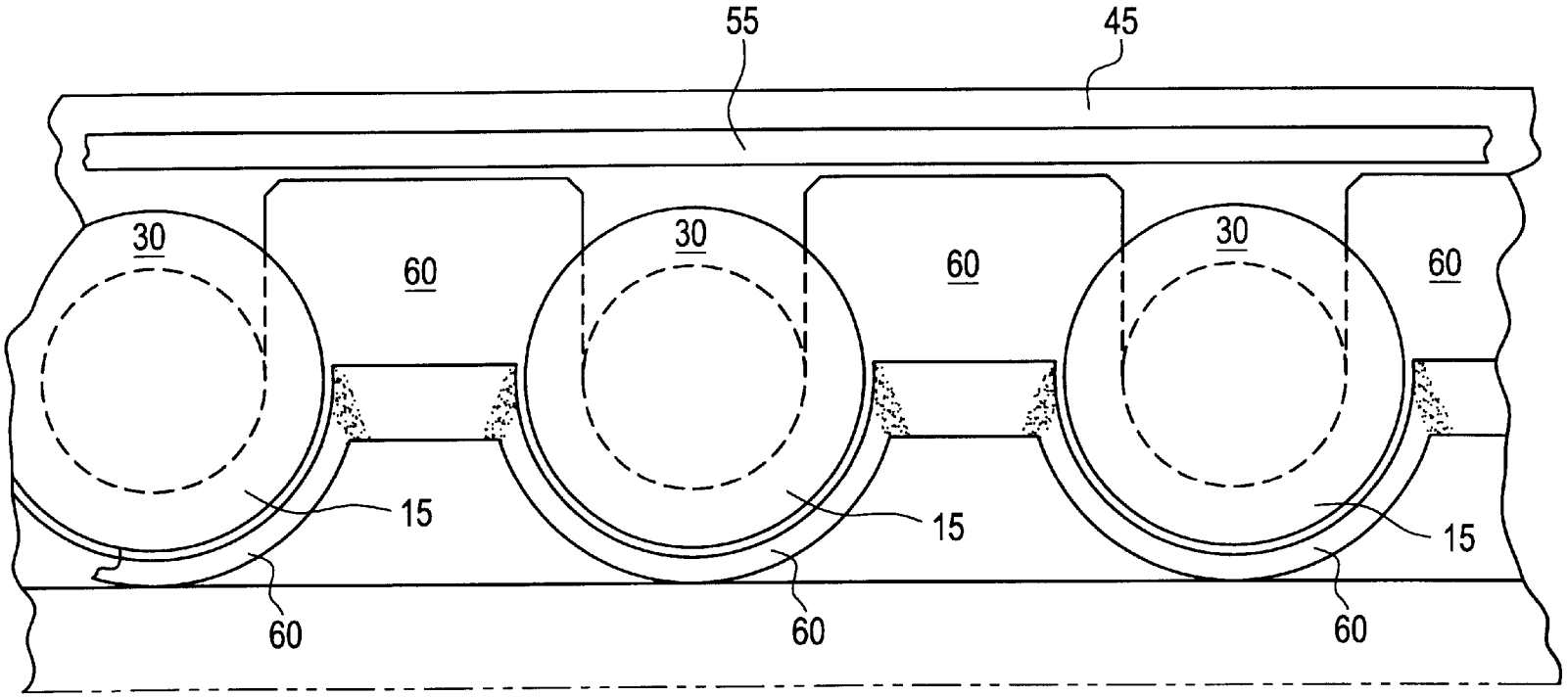
FIG. 14 is a sectional top plan view of the wall section of FIG. 11 taken along line 14—14.
Figure 15:
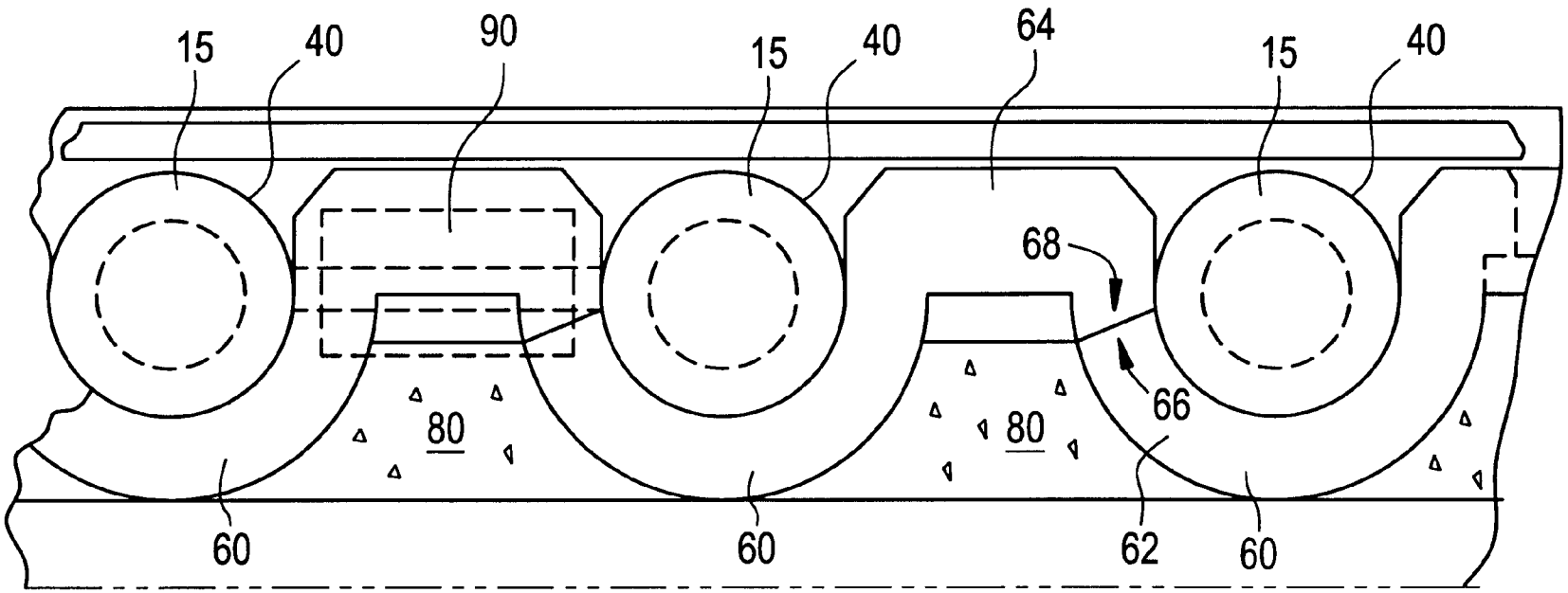
FIG. 15 is a sectional top plan view of the wall section of FIG. 11 taken along line 15—15.

Fitted membrane bars 55 (seen best in FIG. 4) having a bent portion 57 connect the tubes 15 at the swaged sections 30 and reduced diameter sections 40. The shape of the fitted membrane bar 55 is designed to allow the refractory tile 60 to fit over the tubes 15 at both the swaged tube section 30 and at the reduced diameter tube section 40 without projecting into the solids fall line, while permitting refractory material 80 to be used to line the fitted membrane bar 55.

Membrane bars 50 also connect the reduced diameter sections 40 below the refractory tile 60. A mirror image swaged tube section at a lower elevation (not shown) may be used to increase the diameter of the tube 15 back to the diameter of upper tube 20 (or to another diameter which may be larger or smaller than that of the upper tube 20) below the refractory tile 60.

Refractory material 80 covers the tubes 15 below the refractory tile 60. The surface of the refractory material 80 and surface of the refractory tile 60 form a continuous surface and avoid the discontinuity which occurs when the refractory material coating ends.

In the embodiment shown in FIGS. 1–5, the refractory tile 60 is held in place using stud or bolt, and nut connectors 100 to secure the refractory tile 60 to the tubes 15 and fitted membrane bar 55. The refractory tile 60 is provided with suitable apertures 102 in the tail portion 64 through which the stud or bolt and nut connectors 100 may pass. Known means of mounting plates and materials on welded studs in boilers and furnaces can be used for this purpose.

FIGS. 6–10 illustrate an alternate support and mounting structure for the refractory tile 60. In this embodiment, the refractory tile 60 is restrained by an elongated tab 65 which extends vertically from a top edge of the refractory tile 60 between the tubes 15. The top end of the tab 65 is held in interlocking fashion between the tubes 15, fitted membrane bar 55 and membrane bar 50, which extends downwardly past a seal plate 45. The tab 65 is effectively held in the pocket created between the membrane bars 50, 55 and tubes 15. A locking clip 90 is positioned below the bottom edge of the refractory tile 60 and secured to the lower membrane bars 50 using known means, such as a weld, for such connections. The clip 90 holds the refractory tile 60 in place and prevents its movement.

FIGS. 11–15 illustrate a further alternative support and mounting structure for the refractory tile 60. In this embodiment, the refractory tile 60 is restrained by interlocking around the tubes 15 and by the retaining clip 90. The refractory tile would be installed by inserting a top, smaller end of the refractory tile 60 over the reduced tube diameter 40, sliding the refractory tile 60 upwards to engage/lock the refractory tile 60 against the tube 15 at the larger diameter of the swaged portion 30, and then securing the bottom end of the refractory tile 60 by the retaining clip 90.

Figure 16:
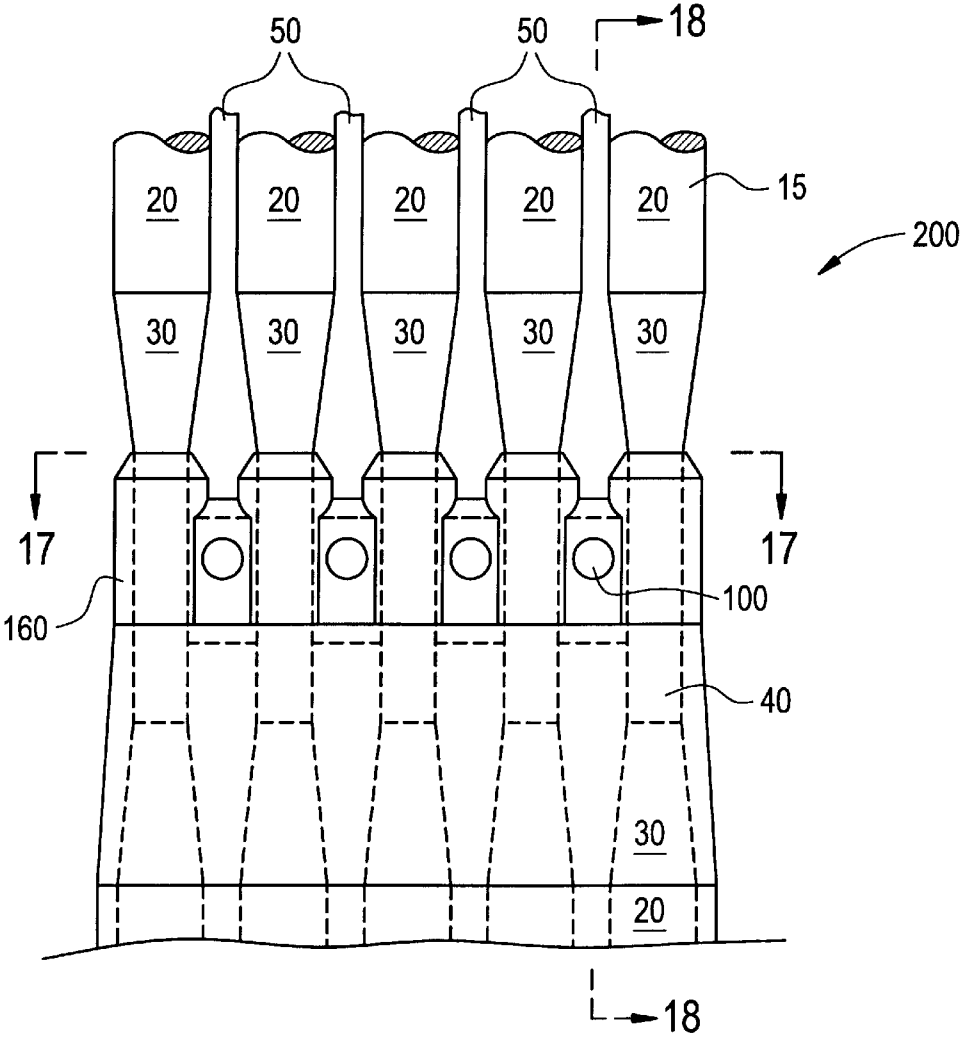
FIG. 16 is a side elevational view of a circulating fluidized bed boiler wing wall or division wall section according to a fourth embodiment of the invention.
Figure 17:
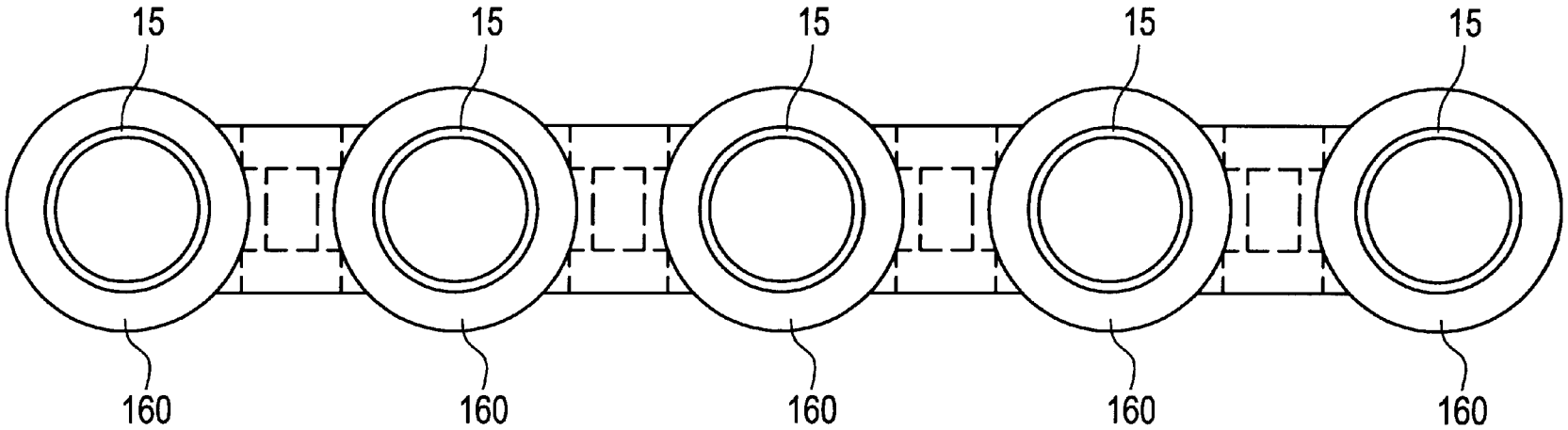
FIG. 17 is a front elevational view of the section of FIG. 16.
Figure 18:
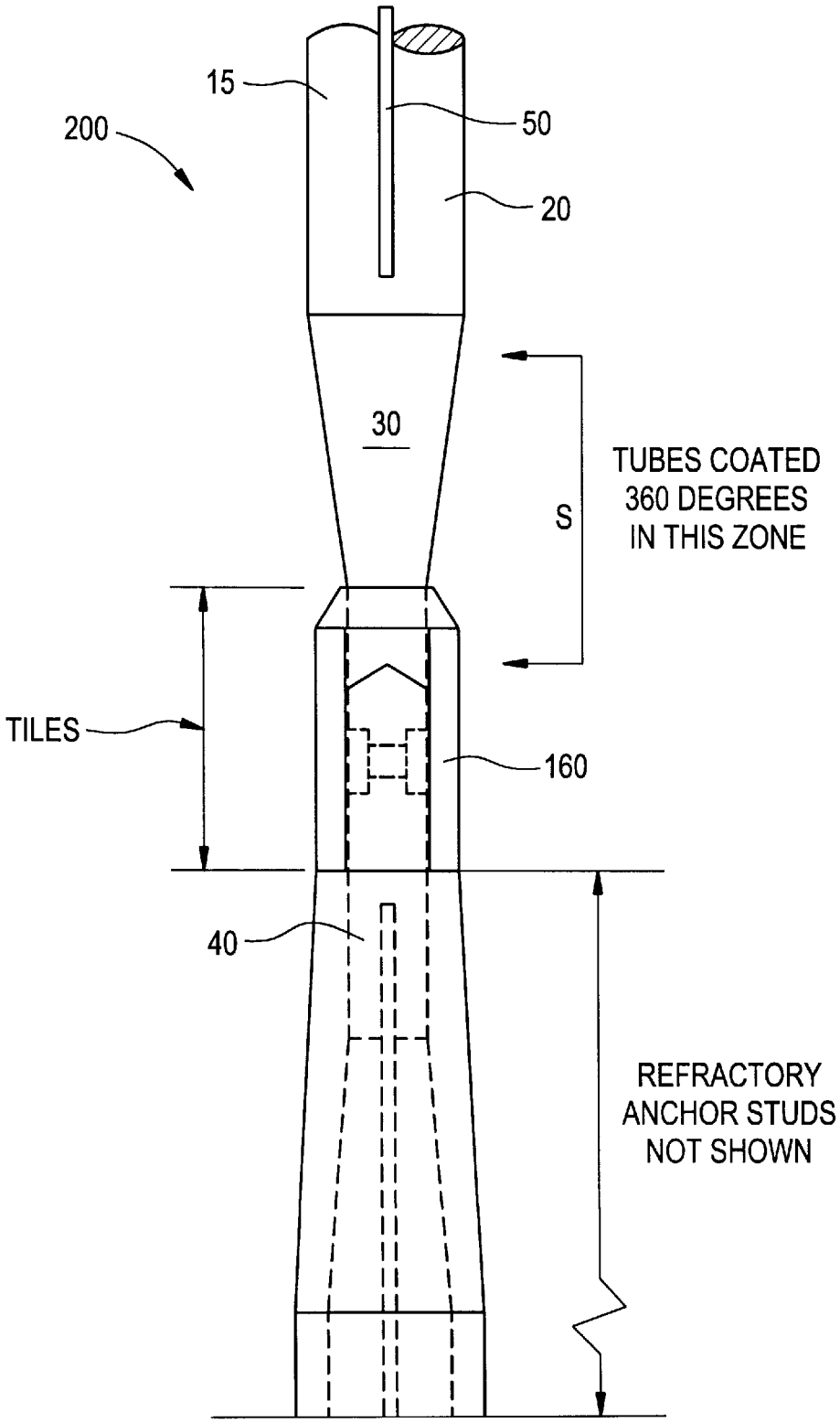
FIG. 18 is a sectional top plan view of the section of FIG. 16 taken along line 18—18.

As indicated earlier, the principles of the present invention are not limited to the protection of circulating fluidized bed (enclosure) walls and can readily be adapted to the protection of similar refractory discontinuities on wing walls or division walls used in such circulating fluidized bed boilers. These aspects are illustrated in FIGS. 16–18. Illustrated therein is a wing wall or division wall section, generally designated 200, comprised of tubes 15 as before. While FIGS. 16–18 only depict five (5) 3 inch outside diameter tubes 15 on, for example 4 inch centers, more or fewer tubes 15 of larger or smaller outside diameters and on different centers may be employed. As before, each of the tubes 15 in the section is formed from upper tubes 20 having at their lower ends a swaged tube section 30 which tapers the outside diameter of tube 15 to a reduced diameter tube section 40, which could be 1.75 inches as before. The tubes 15 may again be provided with membrane bars 50. In this situation, however, the wing wall or division wall section 200 is entirely exposed to the furnace environment, instead of only being subjected to the hot combustion gases and circulating solids on one side. In such applications the refractory tiles 160 would be shaped slightly differently and applied back to back on both sides of the section 200 comprising the wing wall or division wall. Where the membrane bar is stepped back for the enclosure walls, it is simply stopped, leaving a gap, for such wing wall or division wall sections 200 inside the furnace. The refractory tile 160 is again held in place using stud or bolt, and nut connectors 100 to secure the refractory tile 160 to the tubes 15; the refractory tile 160 is provided with suitable apertures 102 through which the stud or bolt, and nut connectors 100 may pass. In the case of division walls or wing walls 200, since the entire section is located within the furnace, it is also more accurate to describe the particular location of the refractory tile 160 or shaped refractory as not having an upper edge thereof not extending beyond the solids fall line defined by the upper tube portion 20.

In all of the foregoing embodiments, to further protect the tubes 15 at the swaged section 30, an abrasion resistant, metallic or non-metallic spray can be used to create a coating 70 of the substance approximately 6–8 mils thick on the exposed portions of the tube 15 at the swaged section 30 and under a portion of the refractory tile 60 as well. Coating 70 would extend for a distance S as required by a given installation's dimensions. As is known to those skilled in the art, several types of metallic and non-metallic protective overlay coatings are available. In the case of divison or wing wall sections 200, such coatings 70 would extend substantially around the entire circumference of the tube 15 at the desired location.

In one application of the invention, the tubes 15 are 3 inch diameter tubes spaced with 4 inches between the centers of each adjacent pair of tubes 15. The swaged tube section 30 reduces the diameter of the tube to 1.75 inches, and the reduced diameter tube section 40 is also 1.75 inches diameter. Preferably, the refractory tile 60 is designed and positioned so as to cover about 3–½ inches of the swaged tube section 30 above the elevation where the diameter is 1.75 inches. The upper portion of the refractory tile 60 tapers toward the upper edge, so that the upper edge of the refractory tile is preferably about ⅝ inches outside the solids fall line defined by the outer surface of the upper tube 20. The upper edge of the refractory tile 60 preferably ends ½ inches or more below the lowest portion of exposed tube 15 that is not coated. Of course, the size and position of the refractory tiles 60 may be varied to suit other tube sizes and spacings.

Suitable materials for the refractory tile 60 include conventional refractory material, silicon carbide, low cement refractory and other, abrasion resistant materials which can withstand the heat experienced inside a circulating fluidized bed.

The present invention reduces the potential for severe tube erosion at the interface of refractory and tube walls or panels without requiring tube bends. This results in no interruption in outside insulation or lagging/casing and allows loads to be taken directly through the centerline of the plane of the tube wall or panel without offsets, thereby simplifying the design of such structures.

While a specific embodiment of the invention has been shown and described in detail to illustrate the application of the principles of the invention, it will be understood that the invention may be embodied otherwise without departing from such principles. For example, the present invention may be used at any point of refractory discontinuity in new circulating fluidized bed boilers, or in the repair or modification of existing refractory discontinuities in circulating fluidized bed boilers. As described above, the present invention may be applied not only to the furnace enclosure walls of such circulating fluidized bed boilers, but also to division or wing wall surfaces where such refractory discontinuities exist.

We claim:

1. A tube wall section for a circulating fluidized bed boiler having a refractory covering, the tube wall section including a plurality of tubes arranged parallel to each other forming a wall, at least one side of the wall of tubes being an interior wall, each tube comprising:

an upper tube section having a first diameter, the side of the upper tube section forming the interior wall defining a solids fall line;

a reduced diameter tube section having a second diameter which is smaller than the first diameter;

a swaged tube section connected between the upper tube section and the reduced diameter tube section;

a plurality of membrane bars connecting the upper tube sections of each of the plurality of tubes; and refractory means mounted over the plurality of tubes and covering at least a part of the swaged tube portion and reduced diameter portion of each tube, the upper edge of the refractory means being outside the solids fall line.

2. The tube wall section according to claim 1, wherein the refractory means comprises shaped refractory placed over the plurality of tubes and covering at least a part of the swaged tube portion and reduced diameter portion of each tube, the upper edge of the shaped refractory being outside the solids fall line.

3. The tube wall section according to claim 1, wherein the refractory means comprises a refractory tile mounted over the plurality of tubes and covering at least a part of the swaged tube portion and reduced diameter portion of each tube, the upper edge of the refractory tile being outside the solids fall line.

4. The tube wall section according to claim 3, wherein the refractory means comprises shaped refractory in addition to the refractory tile.

5. The tube wall section according to claim 4, wherein the refractory means forms a continuous surface with the refractory tile, at least a portion of the continuous surface lying on the solids fall line.

6. The tube wall section according to claim 3, comprising an abrasion resistant coating on exposed portions of the tube at the swaged section and under a portion of the refractory tile.

7. The tube wall section according to claim 3, further comprising mounting means for securing the refractory tile to the plurality of tubes.

8. The tube wall section according to claim 7, wherein the mounting means comprises fitted membrane means for connecting each of the plurality of tubes together at the swaged tube sections and reduced diameter tube section and a plurality of stud and nut connectors holding the refractory tile to the fitted membrane means.

9. The tube wall section according to claim 7, wherein the mounting means comprises fitted membrane means connecting adjacent ones of the plurality of tubes at the swaged tube sections and reduced diameter tube sections, and an elongated tab extending vertically from the top edge of the refractory tile between adjacent tubes at least partly between the membrane bar and the fitted membrane bar.

10. The tube wall section according to claim 7, wherein the mounting means comprises at least one locking clip connecting a bottom of the refractory tile to a lower membrane wall connecting each of the plurality of tubes below the refractory tile.

11. The tube wall section according to claim 3, wherein the refractory tile has a body portion and an upper portion which tapers from the body portion toward the refractory tile upper edge.

12. The tube wall section according to claim 1, further comprising a plurality of fitted membrane bars connected between the swaged tube sections and reduced diameter tube sections, and a plurality of upper and lower seal plates connecting the corresponding upper and lower edges of each fitted membrane bar.

13. A tube section for a circulating fluidized bed boiler having a refractory covering, the tube section including a plurality of tubes arranged parallel to each other, each tube comprising:

an upper tube section having a first diameter, the side of the upper tube section defining a solids fall line;

a reduced diameter tube section having a second diameter which is smaller than the first diameter;

a swaged tube section connected between the upper tube section and the reduced diameter tube section;

a plurality of membrane bars connecting the upper tube sections of each of the plurality of tubes; and refractory means mounted over the plurality of tubes and covering at least a part of the swaged tube portion and reduced diameter portion of each tube, the upper edge of the refractory means not extending beyond the solids fall line.

14. The tube section according to claim 13, wherein the refractory means comprises shaped refractory placed over the plurality of tubes and covering at least a part of the swaged tube portion and reduced diameter portion of each tube, the upper edge of the shaped refractory being not extending beyond the solids fall line.

15. The tube section according to claim 13, wherein the refractory means comprises a refractory tile mounted over the plurality of tubes and covering at least a part of the swaged tube portion and reduced diameter portion of each tube, the upper edge of the refractory tile being not extending beyond the solids fall line.

16. The tube section according to claim 15, wherein the refractory means comprises shaped refractory in addition to the refractory tile.

17. The tube section according to claim 13, comprising an abrasion resistant coating on exposed portions of the tube at the swaged section and under a portion of the refractory tile.

18. The tube section according to claim 13, further comprising a plurality of stud and nut connectors holding the refractory tile to one another around the plurality of tubes.

19. The tube section according to claim 13, wherein the tube section is a division wall.

20. The tube section according to claim 13, wherein the tube section comprises a wing wall.

* * * * *